US011167572B2

(12) United States Patent
Terrero et al.

(10) Patent No.: US 11,167,572 B2
(45) Date of Patent: Nov. 9, 2021

(54) TAPERED ENCODER SHAFT COUPLING FOR IMPROVED SERVICEABILITY AND MOTOR CONTROL

(71) Applicant: XEROX CORPORATION, Norwalk, CT (US)

(72) Inventors: Carlos M. Terrero, Ontario, NY (US); Brian J. Dunham, Webster, NY (US); Steven M. Sippel, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 75 days.

(21) Appl. No.: 16/781,745

(22) Filed: Feb. 4, 2020

(65) Prior Publication Data

US 2021/0237485 A1 Aug. 5, 2021

(51) Int. Cl.
*B41J 11/42* (2006.01)
*B41J 25/00* (2006.01)

(52) U.S. Cl.
CPC ..... *B41J 11/42* (2013.01); *B41J 25/003* (2013.01)

(58) Field of Classification Search
CPC ..... B41J 11/42; B41J 25/03
See application file for complete search history.

(56) References Cited

U.S. PATENT DOCUMENTS

2003/0052261 A1* 3/2003 Chapman ..... G01D 5/34738 250/231.13
2013/0223910 A1* 8/2013 Anderson ..... B41J 11/42 400/578

* cited by examiner

*Primary Examiner* — Lamson D Nguyen
(74) *Attorney, Agent, or Firm* — MH2 Technology Law Group LLP

(57) ABSTRACT

An implementation of an assembly of the present teachings includes a transport roll having a shaft with a tapered surface and an encoder having a coupler that defines a recess and has a tapered surface. During use of the assembly, the tapered surface of the shaft physically contacts the tapered surface of the coupler, and the encoder can be urged toward the transport roll using a spring such as a leaf spring.

9 Claims, 6 Drawing Sheets

TAPERED ENCODER SHAFT COUPLING FOR IMPROVED SERVICEABILITY AND MOTOR CONTROL

TECHNICAL FIELD

The present teachings relate to the field of printing devices and, more particularly, to printer structures for transporting and accurately positioning a print medium relative to a printhead.

BACKGROUND

During a printing operation to dispense an ink onto a print medium, a printer such as an inkjet printer must accurately position the print medium relative to a plurality of nozzles of one or more printheads that eject ink onto the print medium. For example, during one type of high speed printing operation, the printer places a print medium onto an endless vacuum belt that is rotated using a drive roll and applies a vacuum through the vacuum belt to maintain the print medium in position on the rotating vacuum belt. In addition to being rotated using the drive roll, the vacuum belt can rotate around one or more idler rolls. The print medium travels with the rotating vacuum belt and, as the print medium passes the printhead, the nozzles eject ink onto the print medium. The rotational speed and relative position of the vacuum belt, and therefore of the print medium, can be carefully controlled and monitored by a printer controller using one or more encoders, where an encoder is physically coupled to at least the drive roll.

A printer having an increased drop placement accuracy, improved image quality, an increased time between required maintenance, reduced manufacturing tolerances, and an improved serviceability compared to some conventional printers would be a welcome addition to the art.

SUMMARY

The following presents a simplified summary in order to provide a basic understanding of some aspects of one or more implementations of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an implementation, an assembly includes a shaft comprising a tapered surface and a coupler, wherein the coupler defines a recess and includes a tapered surface, and wherein the shaft is positioned within the recess and the tapered surface of the shaft physically contacts the tapered surface of the coupler.

Optionally, assembly can be configured to control and/or monitor a position of a transport roll. In this implementation, the assembly further includes a transport roll comprising the shaft, an encoder comprising the coupler, and a gap positioned between a lateral end of the shaft and the coupler, wherein the lateral end of the shaft is free from physical contact with the coupler during operation of the assembly. Further optionally, the coupler of the encoder can be attached to the shaft of the transport roll using a spring configured to urge the encoder toward the transport roll. The spring can be at least one leaf spring that physically attaches the encoder to the transport roll by way of a spring fit, and the at least one leaf spring can urge the tapered surface of the coupler against the tapered surface of the shaft. The assembly can further include a transport structure, a first bolt that physically attaches the leaf spring to the encoder, and a second bolt that physically attaches the leaf spring to the transport structure.

In an implementation, the shaft can have a longitudinal axis, the tapered surface of the shaft can form a first angle relative to a first line segment that is parallel to the longitudinal axis, where the first angle is from 1° to 30°, and the tapered surface of the coupler can form a second angle relative to a second line segment that is parallel to the longitudinal axis and the first line segment, where the second angle is from 1° to 30°. The first angle can be equal to the second angle.

Optionally, the encoder can further include a collar, and the coupler can be removably attached to the collar using a set screw. The shaft can further include a transverse cross section that is circular where at least a portion of the shaft excluding the tapered surface is a cylinder. The transverse cross section can be at a first lateral extent of the tapered surface of the shaft, a surface of a lateral end of the shaft can form a circular segment defined by an arc and a chord, and the lateral end of the shaft can be at a second lateral extent of the tapered surface of the shaft.

In another implementation, a printer includes a plurality of printheads each having a plurality of nozzles from which ink is ejected during printing, a vacuum belt configured to transport a print medium to the plurality of printheads, a transport roll upon which the vacuum belt rotates during printing, wherein the transport roll comprises a shaft having a tapered surface, an encoder including a coupler, wherein the coupler includes a tapered surface and defines a recess, and a controller configured to operate the vacuum belt and to monitor a position of the print medium relative to the plurality of printheads. In this implementation, the shaft is positioned within the recess and the tapered surface of the shaft physically contacts the tapered surface of the coupler during printing.

Optionally, in this implementation, the coupler of the encoder is attached to the shaft of the transport roll using a spring configured to urge the encoder toward the transport roll. The spring can be at least one leaf spring that physically attaches the encoder to the transport roll by way of a spring fit, and the at least one leaf spring can urge the tapered surface of the coupler against the tapered surface of the shaft. The printer can further include a transport structure, a first bolt that physically attaches the leaf spring to the encoder, and a second bolt that physically attaches the leaf spring to the transport structure. In an implementation, the shaft can have a longitudinal axis, the tapered surface of the shaft can form a first angle relative to a first line segment that is parallel to the longitudinal axis, where the first angle is from 1° to 30°, and the tapered surface of the coupler can form a second angle relative to a second line segment that is parallel to the longitudinal axis and the first line segment, where the second angle can be from 1° to 30°. The first angle can be equal to the second angle.

The printer can further include a gap positioned between a lateral end of the shaft and the coupler such that the lateral end of the shaft is free from physical contact with the coupler during operation of the printer. Optionally, the shaft can further include a transverse cross section that is circular, at least a portion of the shaft excluding the tapered surface is a cylinder, the transverse cross section can be at a first lateral extent of the tapered surface of the shaft, a surface of a lateral end of the shaft forms a circular segment defined by an arc and a chord, and the lateral end of the shaft can be at a second lateral extent of the tapered surface of the shaft.

In another implementation, a method for attaching an encoder to a transport roll includes urging a coupler of the encoder toward a shaft of the transport roll, placing the shaft of the transport roll into a recess defined by the coupler of the encoder, and physically contacting a tapered surface of the encoder with a tapered surface of the shaft of the transport roll. The urging of the coupler toward the shaft can be performed using a spring that may be physically attached to the encoder. The shaft can further include a transverse cross section that can be circular, at least a portion of the shaft excluding the tapered surface can be a cylinder, the transverse cross section can be at a first lateral extent of the tapered surface of the shaft, a surface of a lateral end of the shaft forms a circular segment defined by an arc and a chord, and the lateral end of the shaft can be at a second lateral extent of the tapered surface of the shaft.

BRIEF DESCRIPTION OF THE DRAWINGS

The accompanying drawings, which are incorporated in, and constitute a part of this specification, illustrate implementations of the present teachings and, together with the description, serve to explain the principles of the disclosure. In the figures.

Figure 1:
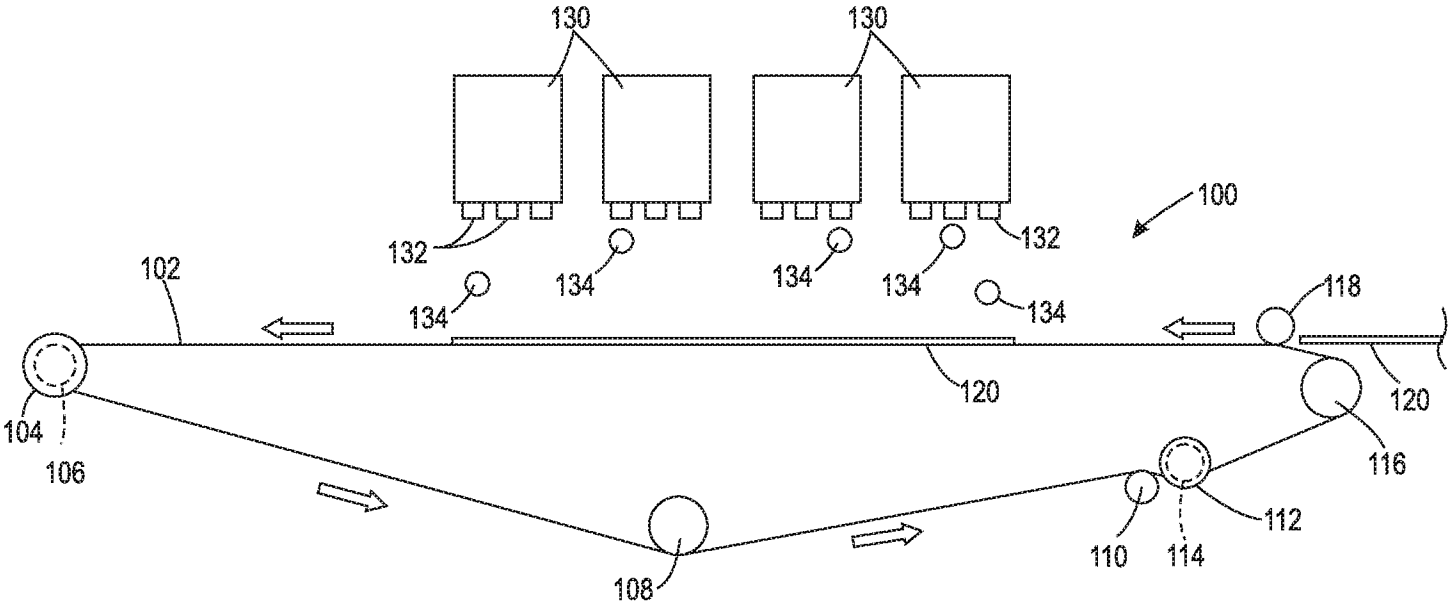
FIG. 1 is a side view of a transport assembly and a plurality of printheads according to an implementation of the present teachings.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary implementations of the present teachings, examples of which are illustrated in the accompanying drawings. Generally and/or where convenient, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Further, a "print medium" can be any print medium such as a cellulosic sheet (e.g., paper, cardboard, wood, etc.), a polymer sheet (e.g., a transparency), cloth, metal, or another print medium.

As discussed above, a printer carefully controls and monitors a rotational speed and relative position of a vacuum belt that is rotated by a drive roll, where the vacuum belt is configured to transport the print medium to the one or more printheads during printing. The vacuum belt can further rotate on one or more idler rolls. As used herein, the term "transport roll" refers to a drive roll, an idler roll, or another type of roll. The printer also controls and monitors a location of a print medium that is positioned on the vacuum belt using one or more encoders, where each encoder is physically coupled to one of the transport rolls. A controller of the printer monitors the velocity and position of the vacuum belt and the print medium position on the vacuum belt using the encoders to monitor the rotation of the transport roll.

In conventional techniques, the encoders can be physically coupled to the transport rolls using various designs such as a through-shaft assembly in which a shaft of the transport roll is inserted completely through the encoder. Another type of encoder includes a blind-shaft assembly in which the shaft of the transport roll is inserted only partly into the encoder. Either technique typically includes the use of set screws embedded in a collar of the encoder assembly. The set screws affix a collar of the encoder to the shaft of the transport roll.

In some printer assemblies, access to the physical connection (i.e., coupling or linkage) between the encoder and transport roll by an operator or technician is blocked by other printer structures that are positioned closely to the encoder and transport roll. Repair or maintenance of the encoder, the transport roll, or the coupling is complicated by the difficulty or lack of access to the various structures. For example, access to the set screws that connect the collar of the encoder to the shaft of the transport roll is difficult due to other printer structures in close proximity to the encoder. Further, to accurately monitor the vacuum belt and the print medium as required for high-quality printing, the coupling must have close-fitting connections manufactured within tight tolerances to prevent a rotational lag and slipping, which would result in inaccurate vacuum belt and print medium positioning, decreased ink drop placement accuracy, misalignment of multi-color image layers, and overall poor image quality. Moreover, gaps in the coupling can result in accelerated wear of mechanical parts and decreased printing accuracy and quality. Additionally, in some printing modes, the encoders and transport rolls rotate at over 500 revolutions per minute, and any spacing or rotational lag in the coupling can cause vibrations or chatter which also decreases the accuracy of ink drop placement and print quality.

With a coupling having a straight shaft that mates with a cylindrical opening in a coupler, the shaft and opening must be machined to close tolerances such that the shaft fits tightly within the cylindrical opening. This is necessary to ensure that when the shaft is rotated, a rotation of the coupler exactly matches the rotation of the shaft so that a position of the vacuum belt is accurately monitored. Manufacturing suitable couplings with the small tolerances required for accurate positional monitoring is difficult and expensive.

Thus the present teachings provide a coupling for connecting and securing an encoder to a transport roll such as a drive roll or an idler roll. The coupling as described herein provides a simplified physical separation of the encoder from the transport roll during maintenance or repair requiring no tools to physically disconnect or separate the encoder from the transport roll. Additionally, the coupling is self adjusting and ensures a close fit between the encoder and the transport roll. However, a coupling according to the present teachings can be manufactured with a smaller and less expensive manufacturing tolerance than other designs, while still maintaining a fit that is suitable for accurately monitoring the rotation of the shaft. Thus a fit of a shaft and coupler according to the present teachings is more robust than some prior designs, because if they are manufactured inaccurately with wide tolerances, the fit remains suitable for accurately monitoring the rotation and position of the shaft, as is described herein.

FIG. 1 depicts a transport assembly 100 according to an implementation of the present teachings. The view of FIG. 1 may be a back view of the transport assembly 100 relative to an installation of the transport assembly 100 within an apparatus such as a printer (600, FIG. 6), although the transport assembly 100 may be otherwise oriented, installed, or positioned within the apparatus. It will be appreciated that the depicted transport assembly 100 is provided as a non-limiting example, and that a transport assembly according to the present teachings can include other structures that have not been depicted for simplicity while various depicted structures can be removed or modified. The transport assembly 100 of FIG. 1 includes a vacuum belt 102, an encoder (e.g., a first encoder) 104, a drive roll 106 (depicted in phantom as not being visible in the side view of FIG. 1), a spring roll 108, a wrap roll 110, an encoder (e.g., a second encoder) 112, an idler roll 114 (depicted in phantom as not being visible in the side view of FIG. 1), a steering roll 116, and an ironing roll 118.

By way of a general description of the particular non-limiting implementation of FIG. 1, the drive roll 106 is controlled by the controller to rotate the vacuum belt 102 during printing. The spring roll 108 can be moved vertically (raised) by an operator so as to loosen the vacuum belt 102 during removal of the vacuum belt 102 from the transport assembly 100 during repair or replacement of the vacuum belt 102. Further, the spring roll 108 can be moved vertically (lowered) by an operator to tighten the vacuum belt 102 during installation or reinstallation of the vacuum belt 102 into the transport assembly 100. The wrap roll 110 is configured to increase a surface area of physical contact between the vacuum belt 102 and the idler roll 114, thereby reducing slippage of the vacuum belt 102 on the idler roll 114 during operation of the transport assembly 100. The steering roll 116 functions as a pivot or gimbal to horizontally align the vacuum belt 102 (i.e., align the vacuum belt 102 with the transport assembly 100 in a direction perpendicular to the plane of the page). The ironing roll 118 is configured to flatten a print medium 120 during placement of the print medium 120 onto the vacuum belt 102 to improve a vacuum take-up of the print medium 120 onto the vacuum belt 102. FIG. 1 further depicts one or more printheads 130 (four of which are depicted by way of example), where each printhead 130 includes a plurality of nozzles 132 from which drops of ink 134 are ejected onto the print medium 120 as the print medium 120 is transported proximate to the printhead 130 by the vacuum belt 102 of the transport assembly 100.

As depicted in FIG. 1, the drive roll 106 and the idler roll 114 are positioned behind the first encoder 104 and the second encoder 112 respectively relative to the orientation of FIG. 1, thereby restricting access to a coupling that physically connects each roll 106, 114 to its respective encoder 104, 112. Other structures of the transport assembly 100, which have not been depicted for simplicity, may further limit access to the couplings.

Figure 2:
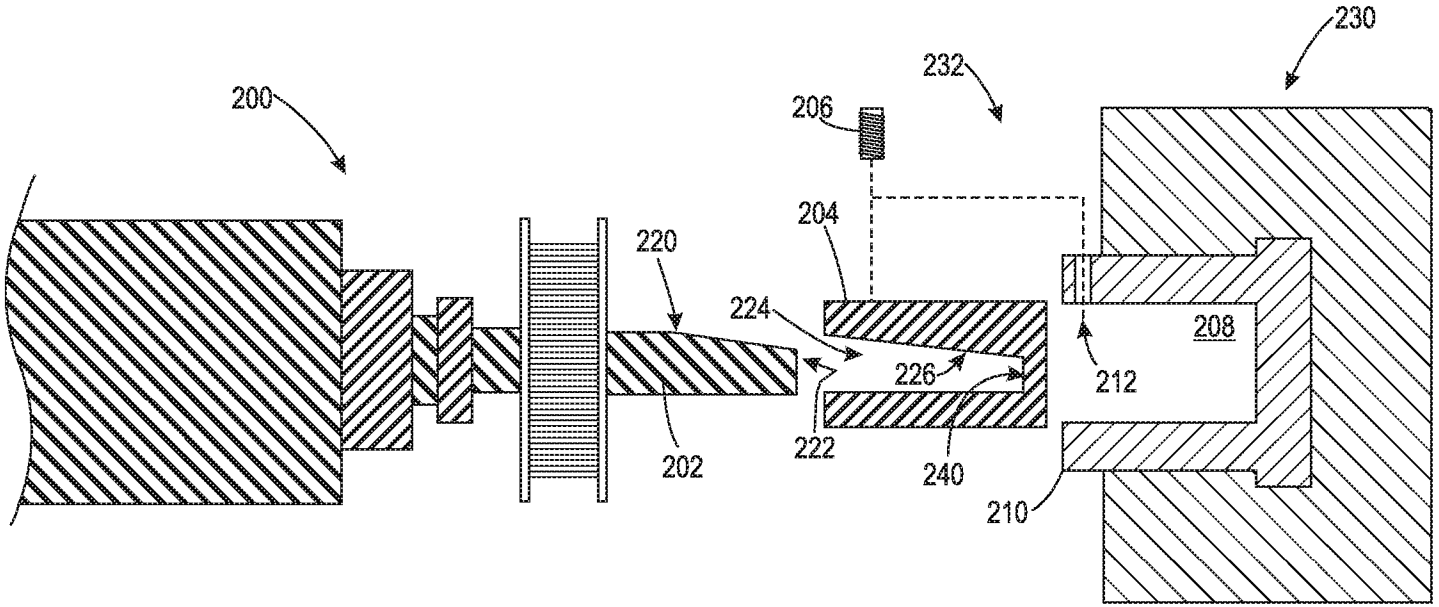
FIG. 2 is an exploded cross section depicting an encoder, a transport roll such as a drive roll or an idler roll, and a coupling according to an implementation of the present teachings.

FIG. 2 is an exploded cross section depicting an encoder 230, a transport roll 200 (e.g., a drive roll 106, an idler roll 114, or another roll), and a coupling 232 that physically connects the shaft 202 of the transport roll 200 with the encoder 230. The coupling 232 as depicted in this exemplary implementation includes a coupler (e.g., a removable insert) 204 and a first fastener 206 such as a threaded set screw 206. During use, the coupler 204 is attached to the encoder 230, and in the implementation of FIG. 2 the coupler 204 can be positioned within a recess 208 defined by a collar 210 of the encoder 230. The coupler 204 can be secured and removably attached to the collar 210 and thus to the encoder 230 using the first fastener 206 that can be positioned within a threaded hole 212 defined by the collar 210. The shaft 202 of the transport roll 200 includes a tapered surface 220, where the shaft 202 tapers toward a lateral end 222 of the shaft 202. During use, the shaft 202 is inserted into a recess 224 defined by the coupler 204. The coupler 204 includes a tapered surface 226 that, in some designs, can match the tapered surface 220 of the shaft 202 of the transport roll 200. In other words, a first angle of the tapered surface 220 of the shaft 202 can be targeted to be the same as a second angle of the tapered surface 226 of the coupler 204. However, manufacturing tolerances can be relatively loose as described below, such that the first angle might not match the second angle, which still allows accurate monitoring of a position of the shaft 202 by the encoder 230. While FIGS. 2-4 depict the tapered surfaces 220, 226 as flat or planar, it will be appreciated that the tapered surfaces 220, 226 can further include contours.

Figure 3:
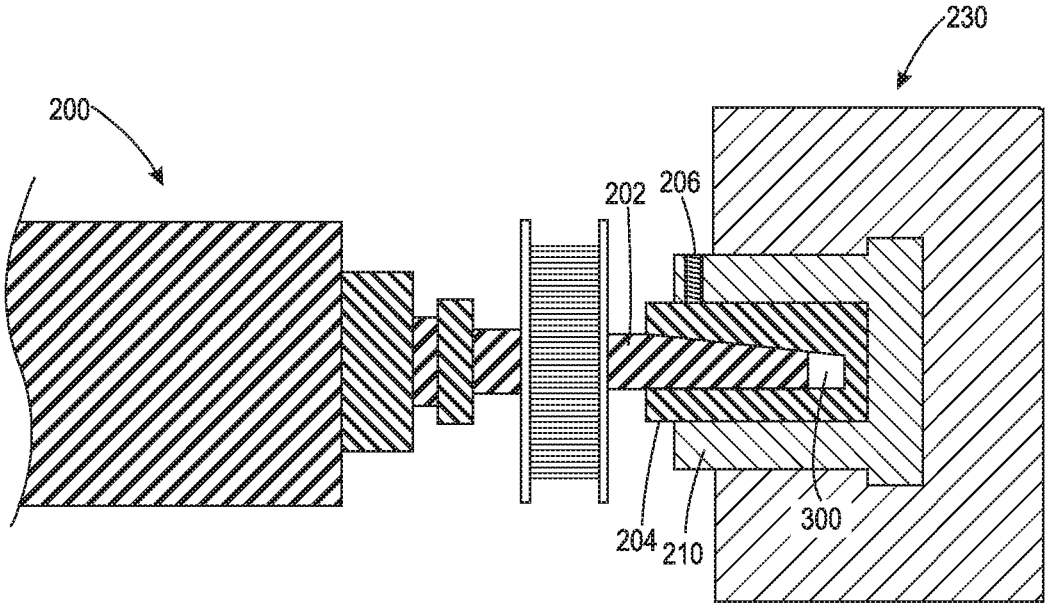
FIG. 3 is a cross section depicting an assembled view of the structures depicted in FIG. 2.

FIG. 3 is a cross section depicting an assembled view of the structures depicted in the FIG. 2 exploded view. In this implementation, the coupler 204 is inserted into the recess 208 defined by the collar 210 of the encoder 230, and the coupler 204 is secured to the collar 210, and thus to the encoder 230, using the threaded screw or other first fastener 206. Next, the shaft 202 of the transport roll 200 is inserted into the recess 224 defined by the coupler 204 so that the tapered surface 220 of the shaft 202 physically contacts the tapered surface 226 of the coupler 204. Once the tapered surface 220 of the shaft 202 physically contacts the tapered surface 226 of the coupler 204, the shaft 202 cannot be inserted further into the recess 224. When assembled, the lateral end 222 (FIG. 2) of the shaft 202 does not physically contact the coupler 204 at an end of the recess 224. In this implementation, a space or gap 300 is positioned between, and defined at least in part by, the lateral end 222 of the shaft 202 and a surface 240 (FIG. 2) of the coupler 204, such that the lateral end 222 of the shaft 202 does not physically contact the surface 240 of the coupler 204 (i.e., the lateral end 222 of the shaft 202 is free from physical contact with the coupler 204). This ensures that, in the event of wear of the tapered surfaces 220, 226 during use, the shaft 202 can still form a tight fit with the coupler 204, as the shaft 202 can be inserted further into the recess 224 defined by the coupler 204. The surface 240 of the coupler 204 can be parallel to the lateral end 222 of the shaft 202 as depicted in FIG. 3, or oblique with the lateral end 222 of the shaft 202.

Figure 4:
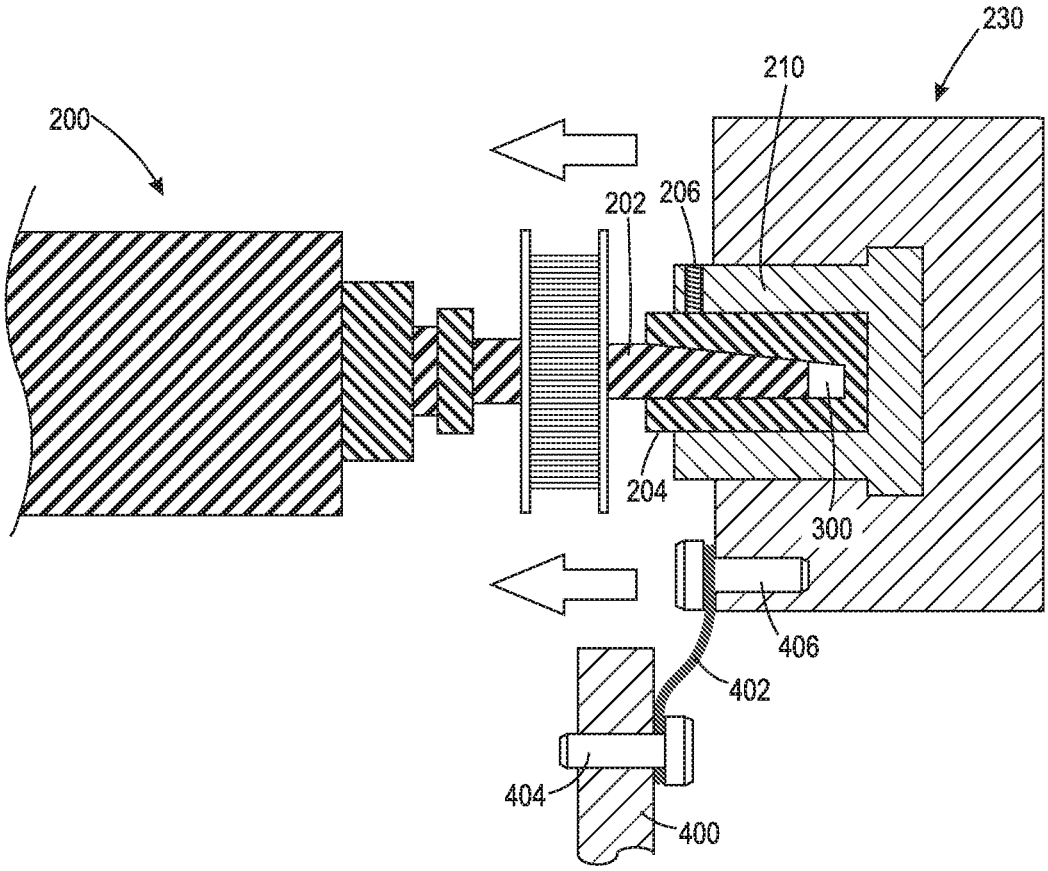
FIG. 4 depicts the assembly of FIG. 3, where the encoder is physically attached to a transport structure of the transport assembly.

FIG. 4 depicts the assembly of FIG. 3, where the encoder 230 is physically attached to a transport structure 400 of the transport assembly 100 such that the encoder 230 is positioned relative to the transport roll 200. The transport structure 400 can be any workable surface, for example, a frame, a plate, a bracket, or another suitable surface. In this implementation, the encoder 230 is attached to the transport structure 400 using one or more springs (e.g., one or more leaf springs) 402, a second fastener (e.g., a first bolt) 404 that attaches a first end of the leaf spring 402 to the transport structure 400, and a third fastener (e.g., a second bolt) 406 that attaches a second end of the leaf spring 402 to the encoder 230. When attached as depicted, the leaf spring 402 applies an engaging force to the encoder 230 that urges the tapered surface 226 of the coupler 204 against the tapered surface 220 of the shaft 202 during installation and use of the encoder 230 and transport roll 200. Thus, in this implementation, the one or more leaf springs 402 physically connect the coupler 204 of the encoder 230 to the shaft 202 of the transport roll 200 by way of a spring fit, where no other fasteners such as bolts, set screws, C-clips, etc., are used to directly connect the encoder 230 to the transport roll 200. In one implementation, removing either the first bolt 404, the second bolt 406, or both, allows the encoder 230 to be removed (e.g., disengaged) from the transport roll 200. In another implementation, the second bolt 406 can be loosened, the coupler 204 can be pulled away from and off of the shaft 202, and the leaf spring 402 and the encoder 230 attached thereto can be rotated about the second bolt 406 to access the transport roll 200. In contrast to some conventional assemblies using a set screw that secures the encoder to the shaft of the transport roll, the first bolt 404 and the second bolt 406 are both easily accessible and are not physically positioned between the encoder 230 and the transport roll 200. As such, encoder 230 can be more easily removed from the transport roll 200.

Figure 5:
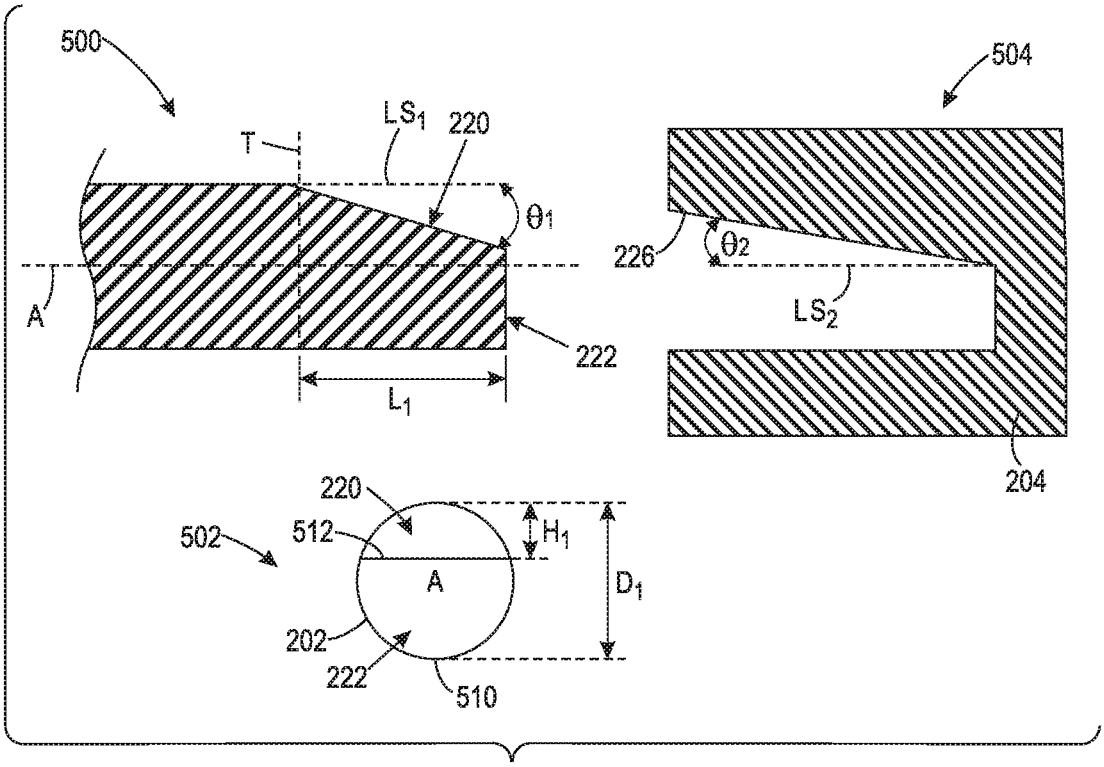
FIG. 5 includes an axial cross section of a portion of a shaft of the transport roll, an end view of the shaft 202, and an axial cross section of a coupler of the encoder.

FIG. 5 includes an axial cross section 500 of a portion of the shaft 202, an end view 502 of the shaft 202, and an axial cross section 504 of the coupler 204. In this example implementation, the shaft 202 includes a longitudinal axis "A" that extends through a center of a circular portion of the shaft 202 at a transverse cross section "T". As depicted, the shaft 202 includes the tapered surface 220, where the tapered surface 220 forms a first angle $\theta_1$ relative to a line segment "$LS_1$" that is parallel to the axis A. Further, the tapered surface 226 of the coupler 204 forms a second angle $\theta_2$ relative to a line segment $LS_2$ that is parallel to the longitudinal axis A and the line segment $LS_1$. In an implementation, $\theta_1$ and $\theta_2$ can both be from about 1° to about 45°, or from about 1° to about 30°, or from about 1° to about 10°, with a tolerance of about ±0.5°, or about ±0.25°, or about ±0.1°. In one implementation, $\theta_1$ can be targeted to equal $\theta_2$. (i.e., $\theta_1=\theta_2$). When $\theta_1=\theta_2$, the entire tapered surface 220 of the shaft 202 can engage with the tapered surface 226 of the coupler 204 during use.

In other implementations, when $\theta_1\neq\theta_2$, the entire tapered surface 220 of the shaft 202 may not engage with the tapered surface 226 of the coupler 204 during use. When $\theta_1\neq\theta_2$, for example when manufacturing tolerances are loose or less accurate machinery is employed to manufacture the shaft 202 and/or coupler 204, physical contact between the tapered surface 226 of the coupler 204 and the tapered surface 220 of the shaft 202 may be a line resulting a linear contact rather than a plane that results in a planar contact. However, even with only linear contact between the tapered surface 226 of the coupler 204 and the tapered surface 220 of the shaft 202, a design according to the present teachings ensures that rotation of the coupler 204 matches the rotation of the shaft 202. Thus the position of the shaft 202, and therefore the position of the vacuum belt 102, can be accurately monitored even with a poor fit between the shaft 202 and the coupler 204. This is in contrast to designs using, for example, a straight shaft and a coupler having a cylindrical opening which require accurate machining and tight tolerances. A design in accordance with the present teachings is therefore more robust than some other designs such as a straight shaft with a cylindrical opening in a coupler.

While the shaft 202 at the transverse cross section T is circular, where at least a portion of the shaft 202 excluding the tapered surface 220 is a cylinder, the surface of the lateral end 222 of the shaft 202 forms a circular segment defined by an arc 510 and a chord 512. As depicted at 500, the tapered surface 220 of the shaft 202 extends from the cylinder that includes the transverse cross section T to the lateral end 222 of the shaft 202, where the transverse cross section T is at a first lateral extent of the tapered surface 220 and the lateral end 222 of the shaft 202 is at a second lateral extent of the tapered surface 220. Further, as depicted in the end view 502, the shaft 202 at the circular transverse cross section T can have a diameter $D_1$ of from about 3 millimeters (mm) to about 500 mm, or from about 3 mm to about 300 mm, and a tolerance of about ±0.08 mm, or about ±0.03 mm.

The tapered surface 220 can have a length $L_1$ that is smaller than a depth of the recess 224 of the coupler 204. This ensures that the lateral end 222 of the shaft 202 does not physically contact the coupler 204, and the space or gap 300 (FIG. 3) is positioned between, and defined at least in part by, the lateral end 222 of the shaft 202 and the surface 240 (FIG. 2) of the coupler 204 as described above. This is in contrast to a through-shaft design, where the shaft extends completely through the coupler, and other designs where no space or gap exists between the end of the shaft and the coupler.

It will be appreciated that a height $H_1$ of the taper 220 of the shaft 202 can be derived from, and is dependent on, the angle $\theta_1$ and length $L_1$ of the taper 220.

In one example method for using the encoder 230 and the transport roll 200, the coupler 204 is secured to the collar 210 of the encoder 230 using the first fastener 206 as depicted in FIGS. 2-4. Next, the leaf spring 402 is attached to the encoder 230 using the third fastener 406. Subsequently, the recess 224 of the coupler 204 is placed onto the shaft 202 of the transport roll 200 to engage the tapered surface 220 of the shaft 202 with the tapered surface 226 of the coupler 204. Once engaged, the shaft 202 cannot be inserted further into the recess 224. Further, the encoder 230 can be secured to a desired transport structure 400 which is a subassembly of the transport assembly 100 using, for example, the second fastener 404. During operation of the printer (600, FIG. 6), the spring 402 urges the encoder 230 onto the transport roll 200 and, more specifically, urges the coupler 204 of the encoder 230 onto the shaft 202 of the transport roll 200 as depicted in FIG. 4 such that the tapered surface 220 of the shaft 202 is maintained in physical contact with the tapered surface 226 of the coupler 204 as depicted in FIG. 4. The physical contact of the tapered surface 220 of the shaft with the tapered surface 226 of the coupler 204 prevents the coupler 204 from slipping on the shaft 202 during rotation of the transport roll 200, yet allows an operator or technician to extract the encoder 230 from the shaft 202 of the transport roll 200 by applying a force to the encoder 230 away from the transport roll 200. Thus when the encoder 230 and/or transport roll 200 requires repair or maintenance, removal of the encoder 230 is simplified compared the conventional designs described above. In some implementations, the second fastener 404 can be removed from physical connection with the transport structure 400, then the encoder 230 can be pulled off of the transport roll 200 and, more specifically, the tapered surface 226 of the coupler 204 can be disengaged from the tapered surface 220 of the shaft 202.

Figure 6:
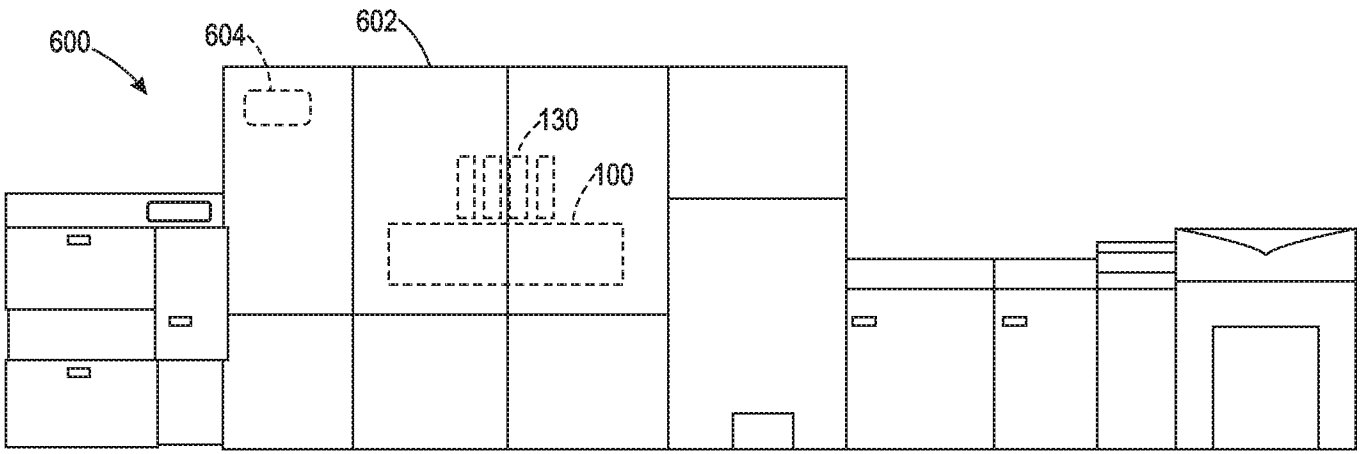
FIG. 6 depicts a printer according to an implementation of the present teachings, such as an ink jet printer that incorporates the transport assembly.

FIG. 6 depicts a front view of an apparatus 600 such as a printer (e.g., a digital press incorporating an ink jet printer) 600 that includes the transport assembly 100. The printer 600 can further include a housing 602 that encases the transport assembly 100, a controller 604 that is configured to operate, monitor, and/or control the mechanical and electromechanical assemblies of the transport assembly 100. The housing 602 further encases various other mechanical, electromechanical, digital, and/or analog components (not individually depicted for simplicity), as well as printhead(s) 130, ink 134, and print media 120.

The present teachings have generally been described with reference to use with a transport roll and an encoder used to monitor a position of a vacuum belt during a printing process. It will be appreciated that this is a non-limiting example usage, and other uses will become apparent to one of ordinary skill. For example, an implementation of the present teachings can be used in any application where a coupling between a shaft and a device or component such as a motor, propeller, tractor peripheral, etc., is required or desired. Furthermore, the specific angles, lengths, heights, diameters, design elements, etc., may vary from those discussed herein depending on the specific design requirements needed to apply the present teachings to a particular use.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or implementations of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated implementation. Finally, "exemplary" indicates the description is used as an example, rather than implying that it is an ideal. Other implementations of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An assembly, comprising:

a shaft comprising a tapered surface; and a coupler, wherein the coupler defines a recess and comprises a tapered surface, wherein the shaft is positioned within the recess and the tapered surface of the shaft physically contacts the tapered surface of the coupler.

2. The assembly of claim 1, wherein the assembly is configured to control and/or monitor a position of a transport roll, the assembly further comprising:

a transport roll comprising the shaft;

an encoder comprising the coupler; and a gap positioned between a lateral end of the shaft and the coupler, wherein the lateral end of the shaft is free from physical contact with the coupler during operation of the assembly.

3. The assembly of claim 2, wherein the coupler of the encoder is attached to the shaft of the transport roll using a spring configured to urge the encoder toward the transport roll.

4. The assembly of claim 3, wherein:

the spring is at least one leaf spring that physically attaches the encoder to the transport roll by way of a spring fit; and the at least one leaf spring urges the tapered surface of the coupler against the tapered surface of the shaft.

5. The assembly of claim 4, further comprising:

a transport structure;

a first bolt that physically attaches the leaf spring to the encoder; and a second bolt that physically attaches the leaf spring to the transport structure.

6. The assembly of claim 2, wherein:

the shaft has a longitudinal axis;

the tapered surface of the shaft forms a first angle relative to a first line segment that is parallel to the longitudinal axis, where the first angle is from 1° to 30°; and the tapered surface of the coupler forms a second angle relative to a second line segment that is parallel to the longitudinal axis and the first line segment, where the second angle is from 1° to 30°.

7. The assembly of claim 6, wherein the first angle is equal to the second angle.

8. The assembly of claim 2, wherein:

the encoder further comprises a collar; and the coupler is removably attached to the collar using a set screw.

9. The assembly of claim 2, wherein:

the shaft further comprises a transverse cross section that is circular;

at least a portion of the shaft excluding the tapered surface is a cylinder;

the transverse cross section is at a first lateral extent of the tapered surface of the shaft;

a surface of a lateral end of the shaft forms a circular segment defined by an arc and a chord; and the lateral end of the shaft is at a second lateral extent of the tapered surface of the shaft.

* * * * *